US007824207B2

(12) United States Patent
Bergner et al.

(10) Patent No.: US 7,824,207 B2
(45) Date of Patent: Nov. 2, 2010

(54) PLUG-IN CONNECTOR WITH A SLEEVE WITH AN UNLOCKING MEMBER

(75) Inventors: Bert Bergner, Bensheim (DE); Werner Boeck, Gross Umstadt (DE); Martin Szelag, Bickenbach (DE); Niranjan Thirunavukkarasu, Neu Isenburg (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 12/683,063

(22) Filed: Jan. 6, 2010

(65) Prior Publication Data

US 2010/0173513 A1 Jul. 8, 2010

Related U.S. Application Data

(63) Continuation of application No. PCT/EP2008/005285, filed on Jun. 27, 2008.

(30) Foreign Application Priority Data

Jul. 6, 2007 (DE) ..... 10 2007 031 504

(51) Int. Cl.
*H01R 13/627* (2006.01)

(52) U.S. Cl. ..... 439/352

(58) Field of Classification Search ..... 439/352, 439/345, 347, 350, 353, 354, 488, 489
See application file for complete search history.

(56) References Cited

U.S. PATENT DOCUMENTS 5,330,366 A 7/1994 Tsuji et al.
5,496,190 A * 3/1996 Ittah et al. ..... 439/354
7,534,125 B1 * 5/2009 Schroll ..... 439/352

FOREIGN PATENT DOCUMENTS

DE 10236275 B3 1/2004

OTHER PUBLICATIONS

International Search Report for PCT/EP2008/005285 dated Feb. 13, 2009, 4 pages.

* cited by examiner

*Primary Examiner*—Chandrika Prasad
(74) *Attorney, Agent, or Firm*—Barley Snyder, LLC

(57) ABSTRACT

A plug-in connector is provided that can be released easily and reliably from an assigned mating connector, and has increased lifetime. The plug-in connector includes a plug head and a sliding sleeve. The plug head has a hollow body with at least one cable connector, and at least two locks located on at least one surface of the body. The locks are connected by a bridge, and extend in a sliding direction. Each lock includes at least one free end. The sliding sleeve includes an opening to receive the plug head in a sliding direction and is movable in an axial direction relative to the plug head. An unlocking element is located on an inner side of the opening and positioned to contact the bridge of the plug head. The unlocking element pushes against the locks when the sliding sleeve moves in the sliding direction.

18 Claims, 2 Drawing Sheets

PLUG-IN CONNECTOR WITH A SLEEVE WITH AN UNLOCKING MEMBER

CROSS-REFERENCE TO RELATED APPLICATIONS

This application is a continuation of PCT International Application No. PCT/EP2008/005285, filed Jun. 27, 2008, which claims priority under 35 U.S.C. §119 to German Patent Application No. DE 10 2007 031 504.1, filed Jul. 6, 2007.

FIELD OF THE INVENTION

This invention concerns a plug-in connector, in particular, to a plug-in connector suitable for a lockable plugging system.

BACKGROUND

Lockable plugging system are known, which protect from unintended release by locking devices such as a plug-in connector and a mating connector that connect axially by a sliding process. The plug-in connector usually includes, in detail, a plug head, on which a sliding sleeve is arranged so that it can move axially, to act as an unlocking device for the plugging system. The sliding sleeve moves in a sliding direction, leading away from the mating connector, to release the locking device of the plugging system. Such a fast lock, which is locked or unlocked by a sliding process, is also known by the term push-pull. The plug head and sliding sleeve of the plug-in connector move against each other by short distances, so that a lock, e.g. in the form of latching hooks and recesses, locks during plugging. For instance, when the plug-in connector moves through the sliding sleeve, by appropriate shaping of the sliding sleeve and the latching hooks of the plug head, the latching hooks lift out of the recesses in the mating connector and unlocking the plug-in connector.

German Patent DE 102 36 275 describes such a plugging system having a known locking device. The described plugging system includes a plug-in connector and a mating connector that can be joined to each other, the plug-in connector having a plug head with an axially movable sliding sleeve. The plug head further includes a hollow body with two locks which extend in the sliding direction, and which have, at their free ends, latching hooks to engage with a latching recess of the mating connector to lock the plugging system. The sliding sleeve includes a recess that corresponds to the lock, and into which the lock extends when the plug head is plugged into the sliding sleeve. The recess of the sliding sleeve is limited by a diagonal surface, the inclination of which corresponds to a sliding diagonal surface of the free end of the locks, so that in the fitted state of the plug-in connector the sliding diagonal surfaces of the lock lie on the diagonal surface of the sliding sleeve. By axial movement of the sliding sleeve, the lock is lifted and put into an unlocked state, so that the plug-in connector can easily be pulled off the mating connector.

However, slight twisting of the sliding sleeve can occur while the sliding sleeve axially moves to release the plug-in connection, resulting in uneven lifting of the locks, resulting from the play which exists between the inner surface of the sliding sleeve and the outer surface of the plug head. Consequently, the latching hook of at least one lock can remain in a locked state, because the latching hook of the lock is not lifted sufficiently out of the latching recess of the mating connector. A locked state here is understood to mean that a latching hook stopper surface is covered by a fastener surface of the latching recess, so that the latching hook and the latching recess cannot move freely in the axial direction relative to each other.

Because of the uneven lifting of the locks and the resulting remaining locked state of at least one lock, the plug-in connector can only be released from the mating connector through a correspondingly greater effort, which overcomes the locked state. This can also result in a break in the region of the latching hook of the lock and/or in a region of the latching recess of the mating connector because of a resulting moment to release the plug-in connection by overcoming the locked state, so that the latching means of the plug-in connection would be damaged, and the plugging system or a corresponding part of the plugging system would have a limited lifetime.

SUMMARY

This invention provides a plug-in connector which can be released easily and reliably from an assigned mating connector and has a greater lifetime.

The plug-in connector includes a plug head and a sliding sleeve. The plug head has a hollow body with at least one cable connector, and at least two locks located on at least one surface of the body. The locks are connected by a bridge, and extend in a sliding direction. Each lock includes at least one free end. The sliding sleeve includes an opening to receive the plug head in a sliding direction and is movable in an axial direction relative to the plug head. An unlocking element is located on an inner side of the opening and positioned to contact the bridge of the plug head. The unlocking element pushes against the locks when the sliding sleeve moves in the sliding direction.

BRIEF DESCRIPTION OF THE DRAWINGS

Further details, advantages and features of this invention are given in the following description of an embodiment, in association with the drawings. In these drawings.

DETAILED DESCRIPTION OF THE EMBODIMENT(S)

An embodiment of the present invention will be described as follows with reference to the drawings.

Figure 1:
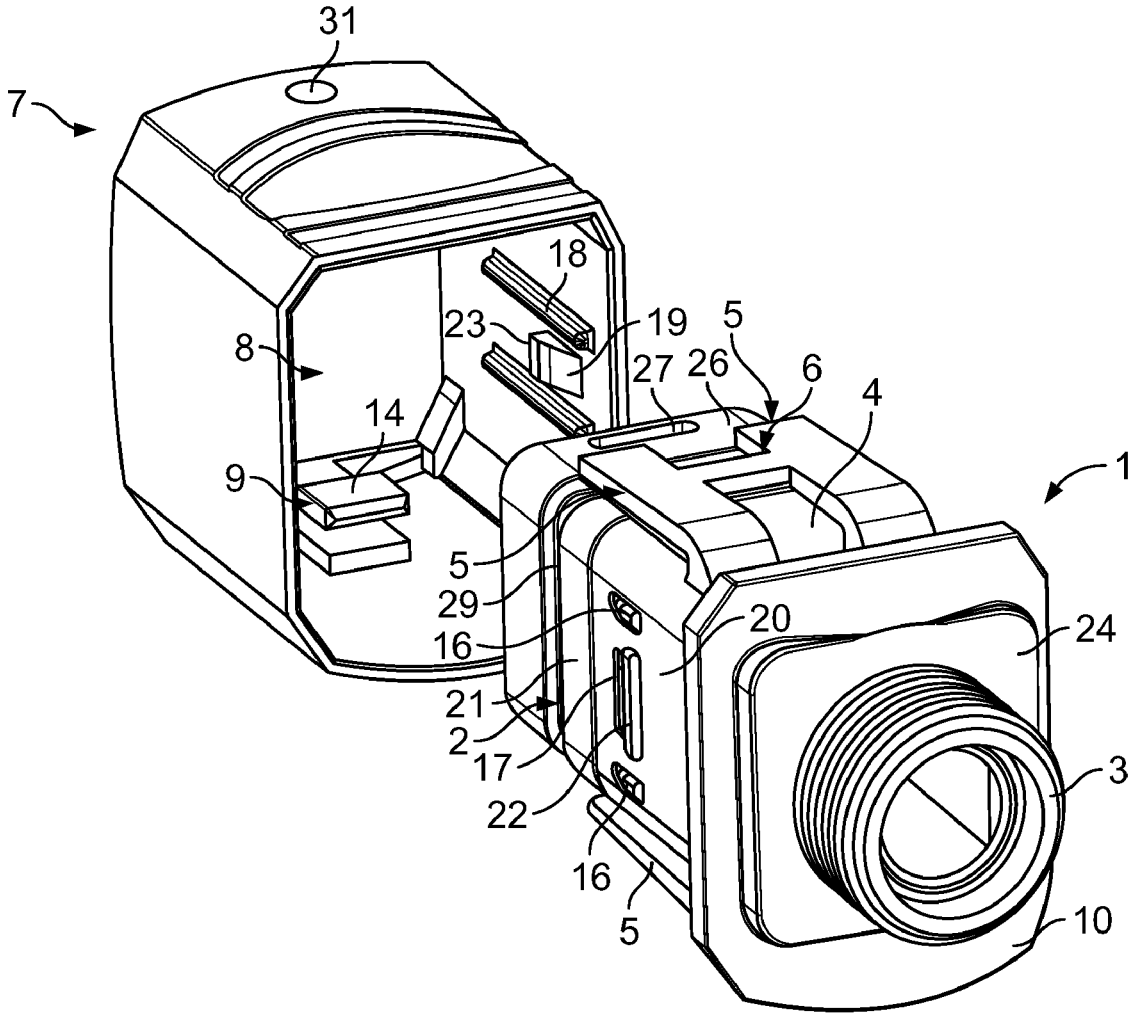
FIG. 1 is an exploded perspective view of a plug-in connector according to the invention.

FIG. 1 shows an exploded perspective view of an embodiment of a plug-in connector, according to the invention, having a plug head 1 and a sliding sleeve 7. The plug head 1 includes a hollow body 2, which is substantially rectangular and has substantially rounded edges. The body 2 has at an end a collar 10 with a projection 24 and a cable connector 3, which is arranged axially thereon. The cable connector 3 is substantially round and has an outer thread that extends from a free end to the projection 24. Additionally, in the cable connector 3, an opening, which communicates with an opening which is delimited by the body 2, is formed. The cable connector 3 is made, for example, from a metal. However, the cable connector 3 can also be made from a different material, e.g. plastic. The projection 24 is made with the collar 10, integrally with the body 2, from a material containing plastic, e.g. by an injection molding process.

The body 2 includes, on each of an upper and a lower surface 4, two locks 5 which extend in an axial direction of the plug head 1 and are connected to each other via a bridge 6, which runs substantially transversely to an axial direction.

The locks 5 each have a free end with a latching hook 15, which projects substantially transversely to the axial direction and radially inward. A projecting part of the latching hook 15 forms a substantially 90 degree angle with a radially inward directed lower side of the locks 5 and runs in the axial direction radially diagonally outward, to graduate in a front end region of the locks 5, through an edge, into the radially outward directed upper side of the locks 5. The diagonal surface of the latching hook 15 which is formed in this way is thus the basis of a guiding surface 14, through which the latching hook 15, in association with the upper and lower surfaces 4, which is assigned to the latching hook surface, of a latching recess of a mating connector (not shown) slides into a recess, which is provided to receive the latching hook 15, of the latching recess, so that the plug-in connector is locked to the mating connector.

The body 2 also includes, on each side surface 20 adjacent to the upper and lower surfaces 4, rail-like outer guides 16 and a central guide 17. The outer guides 16 and the central guide 17 are arranged substantially vertically on the side surface 20, in such a way that the outer guides 16 surround the central guide 17 at a vertical distance from the outer guides 16. The central guide 17, on the side facing the collar 10, forms a substantially right angle with the side surface 20, so that a stopper 22 is formed. On the other hand, a side of the central guide 17, facing away from the collar 10, runs radially inward, and thus forms a diagonal surface in relation to the side surface 20.

The upper and lower surfaces 4 and the side surface 20 graduate on the side opposite the collar 10 into a sliding surface section 21, which is carried radially inward in front; the transition from the surface 4 and the side surface 20 to the sliding surface section 21 running radially inclined inward. In front of the sliding surface section 21, in the sliding direction, a surrounding groove 29 is formed, adjacent to the sliding surface section 21. Additionally, a surrounding end surface 26 is formed, in front of the sliding surface section 21, in the sliding direction. The surrounding groove 29 receives, for example, a sealing ring (not shown), preferably an O-ring, to seal an intermediate space, which is formed between the plug head 1 and the mating connector after latching. The end surface 26 has the same diameter as the sliding surface section 21, and includes, on the side of the body 2 corresponding to the locks 5, slits 27 which run substantially transversely to the sliding direction. The slits 27 can receive latching hooks of a plug block (not shown) which can be inserted into the plug head 1, to latch the plug block with the plug head 1.

The sliding sleeve 7 with the opening 8 has an external diameter which corresponds to the collar 10 of the body 2, and a suitable internal diameter to receive the plug head 1. The sliding sleeve 7 includes an unlocking element 9 on each inner side corresponding to the locks 5. The unlocking element 9 is formed integrally with the sliding sleeve 7, and includes a guiding leg 12 and a lifting leg 13, which carries the guiding leg 12 and which is formed on the side of the guiding leg 12 facing away from the plug head 1 to the inner side of the sliding sleeve 7, in such a way that the guiding leg 12 forms an angle $\alpha$ substantially greater than 90 degrees with the lifting leg 13. In this way, on the side of the unlocking element 9 facing the plug head 1, a suitable gap to receive the bridge 6 is formed. The unlocking element 9 is centered on the inner side of the sliding sleeve 7 substantially transversely to the sliding direction, and arranged longitudinally to the sliding direction so that with the formed gap, the sliding sleeve 7 receives the bridge 6, so that the bridge 6 fits closely on the guiding leg 12 after the sliding sleeve 7 is pushed onto the plug head 1.

During a production process for the sliding sleeve 7 and plug head 1, operations to fix the unlocking element 9 and locks 5, e.g. riveting, gluing or welding, securely on the sliding sleeve 7 and plug head 1 respectively, depending on a choice of material for these plug-in connector components, are unnecessary. The plug-in connector is preferably formed by injection molding from an insulating material containing plastic, but the plug-in connector can also be formed of any other material, according to how the plug-in connector is used. Preferably, at least the locks 5 and/or the unlocking element 9 are formed of an elastic material, to achieve a preloaded close fit.

The sliding sleeve 7 also has, on the inner side corresponding to each of the outer guides 16 and the central guide 17, rail-like outer mating guides 18 and a central mating guide 19. The central mating guide 19 is arranged centrally to the outer mating guides 18. The outer mating guides 18 are formed substantially parallel to the sliding direction with a predetermined length. The outer mating guides 18 and the central mating guide 19 are arranged substantially vertically, in such a way that the outer mating guides 18, in the fitted state of the plug-in connector, are guided in corresponding gaps of the outer guides 16 and the central guide 17.

The central mating guide 19 has, on a side facing away from the plug head 1, a catch 23 and a diagonal surface which first runs away from the catch 23 parallel to the inner side of the sliding sleeve 7 and then runs radially outward to the inner side of the sliding sleeve 7. The diagonal surface, formed in this way, enables the outer guides 16, the central guide 17, the outer mating guides 18, and the central mating guide 19 to slide in such a way that after the sliding sleeve 7 is pushed onto the plug head 1, the stopper 22 comes into contact with the catch 23 in the locked state. In this way, an axial movement of the sliding sleeve 7 against the sliding direction is limited, so that the sliding sleeve 7 is fits on the plug head 1 and cannot be lost. The outer guides 16, the central guide 17, the outer mating guides 18, and the central mating guide 19 are also in such a form that their surfaces facing the plug head 1 and the inner side of the sliding sleeve 7 respectively come into sliding contact with the latter. In this way a close substantially horizontal fit of the sliding sleeve 7 on the plug head 1 is achieved.

The sliding sleeve 7 has, on the outer surface opposite the unlocking element 9, handle strips to make pushing the sliding sleeve 7 manually onto the plug head 1 and moving the sliding sleeve 7 axially on the plug head 1 easier. The sliding sleeve 7 also includes, on the outer surface between the handle strips and the outer surface edge opposite the handle strips, an indicator 31, which is in the form of a protrusion and is integral with the sliding sleeve 7. The indicator 31 assists in orientation of the plug-in connector possible. Here this oriented plugging is understood to mean guided plugging of a plug-in connector with a mating connector, the indicator 31, which for instance are arranged on one side of the plug-in connector and on one side of the mating connector, indicating the sides of the plugging system which correspond to each other in proper orientation of a fit together state. Therefore, a user can easily recognize how the plug-in connector is to be plugged into the mating connector. Oriented plugging can also be provided for the plug head 1 with the sliding sleeve 7 by suitable arrangement of the indicator 31 on the plug head 1 and sliding sleeve 7. In general, the indicator 31 can be in visible and/or tangible form. The indicator 31 can be an elevation, depression, recess or deposited application such as an adhesive spot, or a similar indicator 31, which is formed and provided on the plug-in connector, e.g. on the sliding sleeve 7 or on the plug head 1 according to choice, and preferably on the collar 10, and on the mating connector, at a suitable position. The indicator 31 can be, additionally, a fluorescent or phosphorescent indicator 31, preferably to make oriented plugging by sight possible for the user even in the dark.

Figure 2:
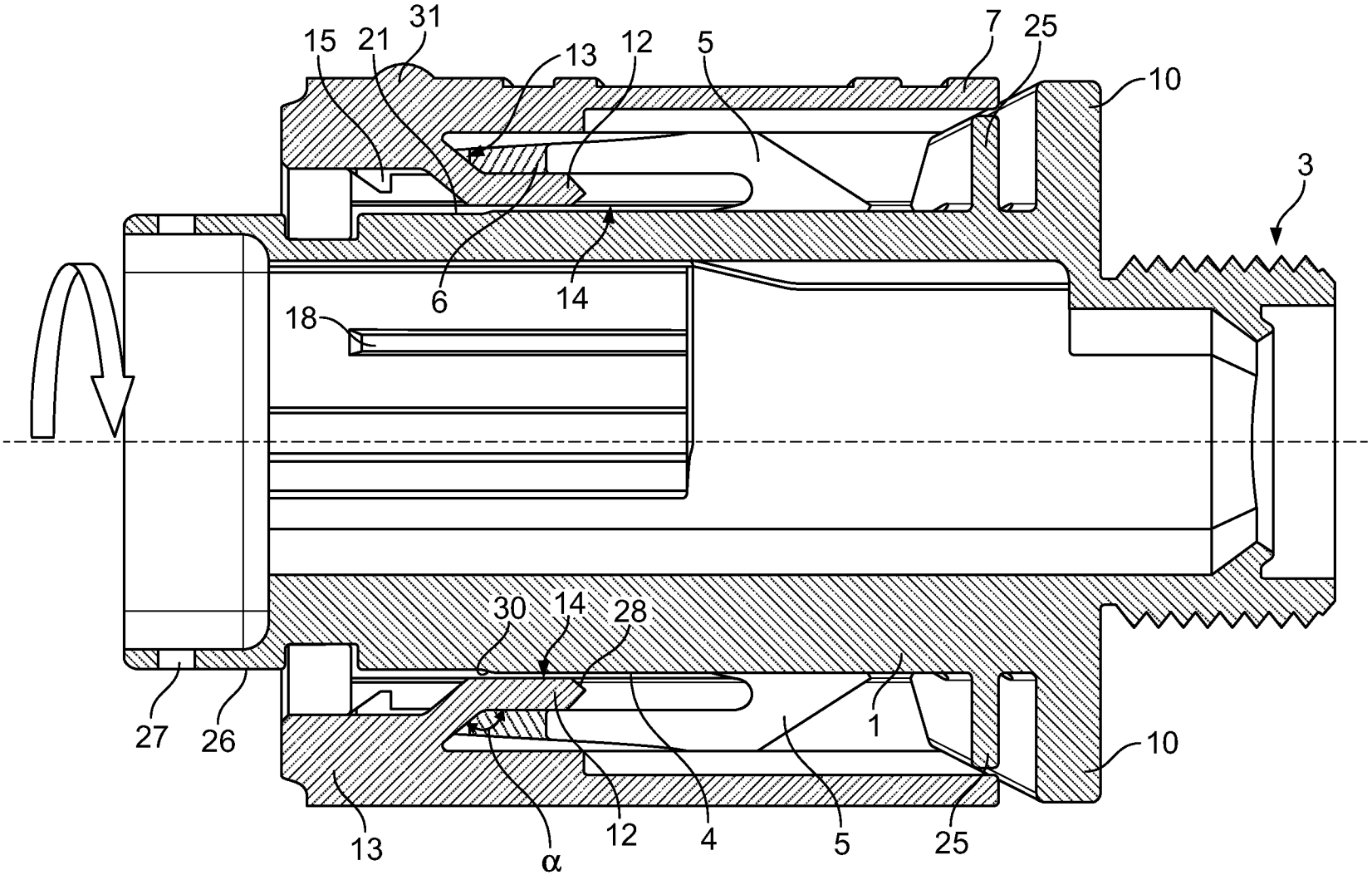
FIG. 2 is a cross-sectional view of the plug-in connector shown in FIG. 1.

FIG. 2 shows a schematic cross-sectional view of the embodiment of the plug-in connector, shown in FIG. 1, in a locked state corresponding to the sliding sleeve 7. The end surface 26 and the slits 27 of the plug head 1 project out of the sliding sleeve 7 in the locked state. The sliding sleeve 7, with the radially inward directed surface of the guiding leg 12 of the unlocking element 9, fits closely on the body 2. Each of the guiding legs 12 has, at the end, an essentially rounded end, so that this end acts as a sliding ramp 28 when the sliding sleeve 7 is pushed onto the plug head 1. It is pushed on in such a way that the outer guides 16 and the central guide 17, with the outer mating guides 18 and the central mating guide 19, make centered guidance of the plug head 1 in the sliding sleeve 7 possible. Since the outer mating guides 18 are guided in the corresponding gaps of the outer guides 16 and the central guide 17, and the plug head 1 with the outer guides 16 and the central guide 17 fits closely without play on the sliding sleeve 7, and simultaneously the sliding sleeve 7 with the outer mating guides 18 and the central mating guide 19 fits closely without play on the plug head 1, rotation of the sliding sleeve 7 can be prevented to a very large extent during engagement.

Resulting from easy guidance of the guiding surface 14 of the guiding leg 12 over the end surface 26 of the body 2 and subsequently over the sliding surface section 21, the connection becomes more play-free and tilt-free as the sliding sleeve 7 is pushed further onto the plug head 1. In this case, a radially outward directed side of the guiding leg 12 first comes into a close fit with the bridge 6, without preload. As the sliding sleeve 7 is pushed further, the guiding leg 12 is pushed radially outward because of guidance of the sliding ramp 28 over the shoulder 30, so that a preloaded close fit of the bridge 6 with the unlocking element 9 and of the unlocking element 9 with the body 2 is achieved.

When the stopper 22 comes into contact with the catch 23, the sliding sleeve 7 is in the locked state, which simultaneously defines an end to the process of pushing the sliding sleeve 7 onto the body 2 of the plug head 1. The bridge 6 has, on the side facing away from the collar 10 and radially directed inward, a diagonal surface, corresponding to the inclination of the lifting leg 13. Consequently the bridge 6 also fits closely on the lifting leg 13, so that a vertical close fit of the sliding sleeve 7 on the plug head 1 is achieved. The gap which is formed by the guiding leg 12 and the sliding sleeve 7, and which receives the bridge 6, has such a height that when the sliding sleeve 7 moves in the sliding direction to release the plug-in connection, the bridge 6 lifts the locks 5 so far that they reach a position corresponding to the unlocked state. During this shifting movement, the sliding sleeve 7, as mentioned above, fits horizontally over the outer mating guides 18 and the central mating guide 19, and simultaneously, vertically preloaded, over the unlocking element 9 on the plug head 1, without play. The play-free, preloaded close fit is achieved correspondingly for the plug head 1 by the outer guides 16, the central guide 17, the bridge 6 and the surface 4. As a result, rotation of the sliding sleeve 7 around the movement axis when the sliding sleeve 7 moves is reliably prevented. The locks 5 thus lift evenly from the body 2 by the bridge 6, so that the plug-in connection can easily be released.

When the sliding sleeve 7 is in a locked position, as shown in FIG. 2, the sliding sleeve 7, with its end near the collar 10, lies on a bracing collar 25, which is carried in front of the collar 10 in the sliding direction. Additionally, a distance between the radially outward facing surface of the locks 5 and the inner side of the sliding sleeve 7 (opposite the handle strip), is chosen to be minimal so that in the case of axial movement of the sliding sleeve 7, because of a compressive force which is first directed radially inward onto the sliding sleeve 7 and then axially directed, the effect of the locks 5 is not affected. This results because the end of the sliding sleeve 7 near the collar 10 lies on the bracing collar 25. Even if the bracing collar 25 is shown in surrounding form, the bracing collar 25 can only be formed on the surfaces of the body 2, or be in a similar form which claims a bracing function for the sliding sleeve 7 for itself.

The unlocking element 9 of the sliding sleeve 7 is in such a form that in the case of an axial movement of the sliding sleeve 7 in the sliding direction from the body 2, the bridge 6 lifts to the unlocked state. Thus a space-saving arrangement of the locks 5 with respect to the bridge 6 and the unlocking element 9 is made possible, since the space to be provided between the body 2 and the inner side of the sliding sleeve 7, in the locked state of the plug-in connector, can be kept small by a compact arrangement of the locks 5 with the unlocking element 9, which is arranged between the locks 5.

In the embodiment shown, the unlocking element 9 in the locked state fits closely on the surface 4 of the body 2. In this way, any play that exists between the sliding sleeve 7 and the body 2 of the plug head 1 can be reduced, so that twisting of the sliding sleeve 7 to bring the locks 5 into the unlocked state can be counteracted. Here in particular, the locks 5 fit closely on the unlocking element 9 under preload. This preload can be achieved, for instance, by the locks 5 from their end connected to the body 2 to their free end being formed to be slightly radially inclined inward, so that the unlocking element 9 in the locked state lifts the locks 5 slightly, to use a generated radially inward acting force of the locks 5 as a preloading force. The preload of the locks 5 onto the unlocking element 9 can also be chosen so that the preloading force acts on the body 2 through the unlocking element 9, to allow the unlocking element 9 to fit closely on the body 2 under preload when the locked state is reached. In this way a play-free, close fit of the unlocking element 9 on the body 2 is reliably ensured, so that the sliding sleeve 7 also fits closely on the plug head 1 in the region of the unlocking element 9. Additionally, in the embodiment shown, the bridge 6 is provided in the region of the free end of the locks 5. Thus the necessary force to lift the locks 5 into the unlocked state is reduced, so that a smaller or slimmer shape of the unlocking element 9 and of the bridge 6 becomes possible. The collar 10, which is provided as a stopper 22 for the sliding sleeve 7, limits the movement of the sliding sleeve 7 in the sliding direction. Thus an undesired axial movement of the sliding sleeve 7 in the sliding direction during an unlocking process of the plug-in connector, through a position which damages the bridge 6 and/or unlocking element 9, can be prevented.

Besides these, the configurations described in the above-described embodiment can be selected optionally or can be changed appropriately in to other configurations without departing from the spirit and scope of the present invention.

What is claimed is:

1. A plug-in connector, comprising:

a plug head having a hollow body with at least one cable connector;

at least two locks located on at least one surface of the body and connectable by a bridge, the at least two locks extending in a sliding direction and having at least one free end;

a sliding sleeve having an opening to receive the plug head in the sliding direction and being movable in an axial direction relative to the plug head;

an unlocking element located on an inner side of the opening, the unlocking element positioned to contact the bridge and biasing the at least two locks when the sliding sleeve moves in the sliding direction.

2. The plug-in connector according to claim 1, wherein the unlocking element lifts the bridge during axial movement of the sliding sleeve.

3. The plug-in connector according to claim 2, wherein the unlocking element further comprises a guiding leg having a free end.

4. The plug-in connector according to claim 3, wherein the unlocking element further comprises a lifting leg connecting to the guiding leg, the lifting leg forming an angle with the guiding leg of greater than 90 degrees.

5. The plug-in connector according to claim 4, wherein the unlocking element further comprises a guiding surface, which fits on the at least one surface of the body during locking.

6. The plug-in connector according to claim 1, wherein the body further comprises a sliding surface section located axially in front of the at least one surface.

7. The plug-in connector according to claim 6, wherein the unlocking element further comprises a sliding ramp urging the unlocking element radially outward when the sliding sleeve is positioned on the plug head.

8. The plug-in connector according to claim 1, wherein the unlocking element is formed integrally with the sliding sleeve.

9. The plug-in connector according to claim 1, wherein the at least two locks are formed integrally with the body.

10. The plug-in connector according claim 1, wherein the bridge is located in a region of the at least one free end of the at least two locks.

11. The plug-in connector according to claim 1, wherein the plug head further comprises a collar located between the body and the cable connector, the collar limits movement of the sliding sleeve in the sliding direction.

12. The plug-in connector according to claim 1, wherein the plug head further comprises guides.

13. The plug-in connector according to claim 12, wherein the sliding sleeve further comprises mating guides corresponding to the guides.

14. The plug-in connector according to claim 13, wherein the guides form a stopper and the mating guides form a catch, the stopper and catch prevent movement of the sliding sleeve against the sliding direction.

15. The plug-in connector according to claim 13, wherein the guides are located on at least one side surface of the body adjacent to the at least one surface.

16. The plug-in connector according to claim 15, wherein the mating guides are located in the opening on an inner side and correspond to the guides.

17. The plug-in connector according to claim 1, further comprising at least one indicator.

18. The plug-in connector according to claim 17, wherein the at least one indicator is arranged on the sliding sleeve.

* * * * *